US005398350A

United States Patent [19]

Watkins et al.

[11] Patent Number: 5,398,350

[45] Date of Patent: Mar. 21, 1995

[54] PORTABLE SPA COVER

[75] Inventors: Jeffrey K. Watkins, Rancho Santa Fe; Walter R. Cumiskey, Vista, both of Calif.

[73] Assignee: Watkins Manufacturing Corporation, Vista, Calif.

[21] Appl. No.: 205,609

[22] Filed: Mar. 3, 1994

[51] Int. Cl.[6] ..... E04H 4/08

[52] U.S. Cl. ..... 4/498; 220/333

[58] Field of Search ..... 4/498, 503, 506, 580; 220/333, 908

[56] References Cited

U.S. PATENT DOCUMENTS

| | | | |
|---|---|---|---|
| 3,072,920 | 1/1963 | Yellott | 4/498 X |
| 4,213,539 | 7/1980 | Reuter | 220/333 |
| 4,279,357 | 7/1981 | Robinson | 220/908 X |
| 4,391,386 | 7/1983 | Moret | 220/333 X |
| 4,422,192 | 12/1983 | Jacobs | 4/498 |
| 4,577,352 | 3/1986 | Gautheron | 4/498 X |
| 4,749,606 | 6/1988 | Moore | 4/498 X |
| 4,853,985 | 8/1989 | Perry | 4/498 |
| 4,857,374 | 8/1989 | Perry | 4/498 X |
| 5,086,525 | 2/1992 | Christopher | 4/498 |
| 5,248,057 | 9/1993 | Taylor | 220/333 |

OTHER PUBLICATIONS

Flyer of Hot Spring Portable Spas re "The Tip Top" Spa Cover, 1991, 1 page.

Brochure of the Centech Corporation entitled, "Tub Cap" (no date), 4 pages.

Brochure of Softub entitled, "Series by Softub" (no date), 8 pages.

Flyer of Softub er "Softop" (no date), 1 page.

Brochure of Softcare entitled, "Softcare Essentials" (1993), 8 pages.

*Primary Examiner*—Robert M. Fetsuga

*Attorney, Agent, or Firm*—Price, Gess & Ubell

[57] ABSTRACT

A portable spa including a cover having two semi-circular, rigidly molded, interlocking halves, designed to conform with the contour of the rim of the spa. The cover halves each have an undersurface and outer surface with a plurality of radial support ribs being formed in the undersurface to provide strength and rigidity. Elongated, tapered male and female hinge members are integrally molded as part of the respective cover halves and permit the cover halves to be engaged and disengaged from one another when at an angle with respect to each other, while remaining firmly locked together when each half lies horizontally. The horizontal engagement is further facilitated by resilient fingers which extend out from the male projection at intervals along the cover edge and provide a resiliently biased interlocking mechanism.

36 Claims, 5 Drawing Sheets

PORTABLE SPA COVER

BACKGROUND OF THE INVENTION

1. Field of the Invention

The subject invention relates to spas, whirlpools, and the like and, more particularly, to an improved cover for use with portable spas.

2. Description of Related Art

Portable spas are generally known in the prior art and have become increasingly popular as a source of relaxation and physical therapy. Their structure generally includes a spa shell or "tub" fabricated of various materials such as fiberglass/acrylic or various thermoplastics, a layer of thermal insulation placed against the shell, and a wooden support structure, often employing a 2×4 frame. In many cases, the exterior of the spa is a continuation of the shell. In some cases, decorative redwood patterns have been applied to serve as the exterior sidewalls or "skirts" of free-standing units. Decorative tile work has also been variously used in the interior and exterior design of portable spas.

In order to retain heat and reduce evaporation, portable spas have been fitted with insulating covers. The most commonly used cover is made of cut styrofoam halves surrounded by a sewn vinyl covering and permanently hinged together. This structure provides a flat cover, which is simply slid over the top of the spa when the spa is not in use. Another known spa cover for use with a so-called "soft core" spa is formed of one-piece polyethylene foam with a hand-sewn cover and fits into the spa like a cork. Other covers have employed foam cores with more resilient rigid covering materials and have employed various spring-biased hinged mechanisms for raising and lowering because of their considerable weight.

To meet industry safety standards such as ASTM F1346-91, spa covers must meet static load, deflection, and surface drainage standards. Under ASTM F1346-91, a spa cover must support a weight of 485 pounds. A deflection test must be met to ensure that if a child under five falls on the cover, he cannot slip through any openings. The surface drainage standard ensures that the cover will not retain enough water to risk drowning of a small child.

Spa covers of the prior art in general suffer from a number of drawbacks. The conventional spa covers are labor intensive to manufacture, cumbersome to use, and have a notoriously short life span in the face of hot chlorinated water, sunlight, and the wear and tear of use. Many of the designs, such as the soft core "cork," cannot meet industry safety standards.

OBJECTS AND SUMMARY OF THE INVENTION

It is therefore an object of the invention to improve covers used in connection with portable spas and similar pool structures;

It is another object to increase the life of covers used in conjunction with spas;

It is another object to improve the ease of use of spa covers; and

It is another object to provide a spa cover design which is relatively lightweight and easy to use and which can meet industry safety standards;

According to the invention, an improved portable spa cover integrating several novel aspects into the overall design is provided. These aspects include rigidly molded, interlocking cover halves, adapted to rest on the upper rim of the spa. The cover halves each preferably include an outer surface and an inner surface with a plurality of support ribs being provided to add strength and rigidity. Hinge means are provided which prevents disengagement when both halves are lying horizontal and which enable the cover members to be engaged and disengaged when one of the cover halves is horizontally disposed and the other half is at an acute angle to the horizontal. According to another aspect of the invention, the hinge means includes finger means which bias the cover halves together and further bolster and secure their horizontal relation.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings, of which:

DETAILED DESCRIPTION OF THE PREFERRED EMBODIMENTS

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein specifically to provide readily manufacturable and particularly useful portable spa improvements.

Figure 1:
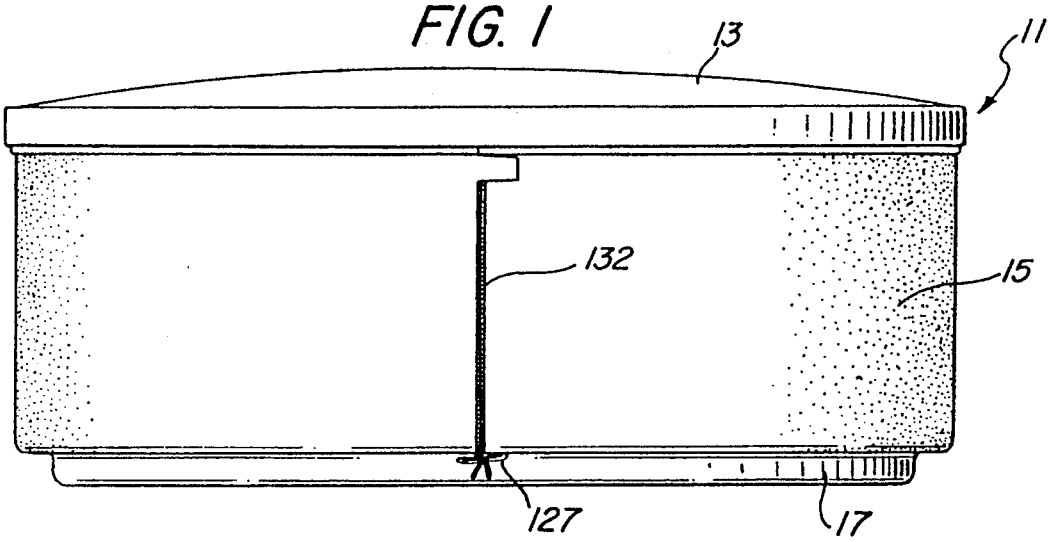
FIG. 1 is a side elevational view of a spa wherein the preferred embodiment may find application.

FIG. 1 illustrates a spa or pool 11 whereupon is mounted a spa or pool cover 13 according to the preferred embodiment. The spa 11 further includes a decorative, interchangeable side skirt 15 and a bottom pan 17. The skirt 15 includes a zipper 132 and is removable and replaceable by skirts of, for example, different colors.

Figure 2:
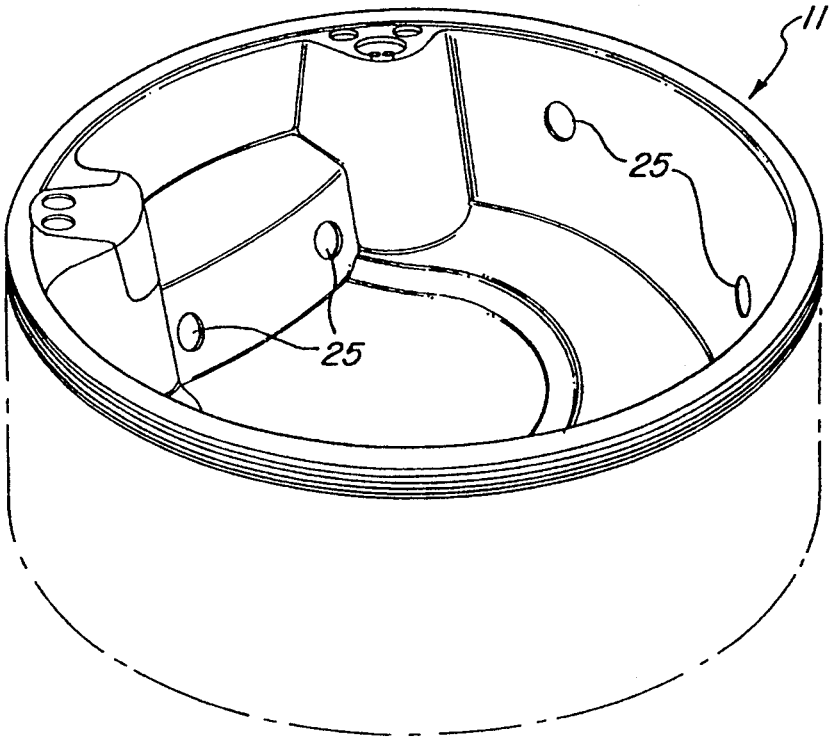
FIG. 2 is a perspective view of a spa according to FIG. 1 with the cover removed.

FIG. 2 shows a typical interior configuration of the spa 11, including jet openings 25 and seating areas. The particular interior detail is, of course, variable, as will be appreciated by those skilled in the art.

Figure 3:
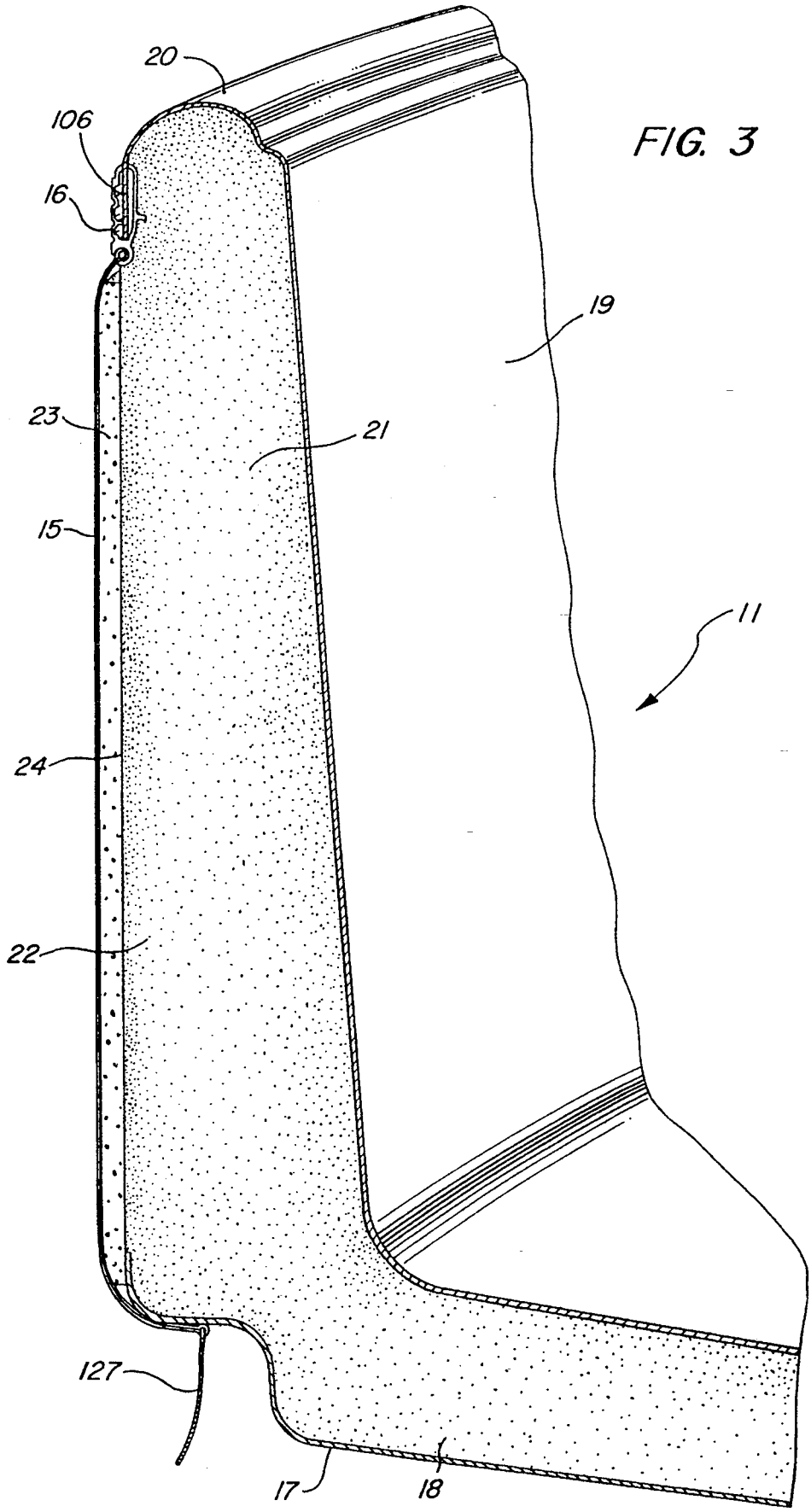
FIG. 3 is a partial side sectional view of the spa of FIG. 1.

As shown in FIG. 3, the spa interior is provided by a molded shell 19, which may be molded from fiberglass, acrylic, polypropylene, or other materials. The shell 19 includes a crowned upper rim 20 having a depending vertical edge or lip 106. Adjacent the shell 19 is a layer of rigid foam insulation 21 which defines the exterior contour of the spa 11, providing a bottom surface 18 and a side surface 22. The foam insulation 21 is preferably a rigid, two-pound density, closed cell, polyurethane foam. The bottom surface 18 is contoured to conform to the interior surface shape of the bottom pan 17. The bottom pan 17 itself is waterproof and is glued to the rigid foam insulation 21 in order to provide a sealed, water impervious surface. The interchangeable skirt 15 is positioned adjacent the side surface 22 and includes interior foam padding or batting 23 and a backing layer of cloth material 24. The upper edge of the interchangeable skirt 15 inserts within the lower edge of an extrusion 16, which attaches to the depending vertical edge 106 of the spa rim 20.

Figure 4:
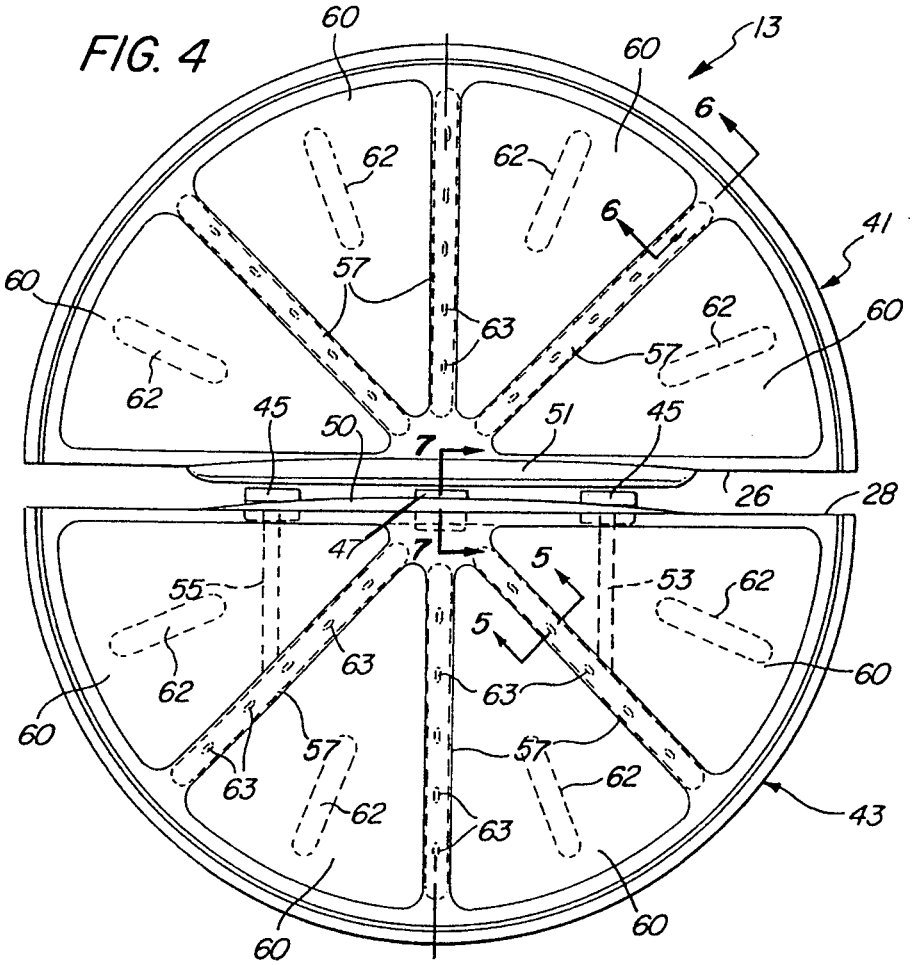
FIG. 4 is a top view of the spa cover according to the preferred embodiment.

The top cover 13 according to the preferred embodiment is shown in more detail in FIGS. 4–11. The top cover 13 shown in FIG. 4 is generally circular and includes a female half 41 and a male half 43. These halves 41, 43 are adapted to abut one another along corresponding edges 26, 28. Each half 41, 43 further includes three identically-formed ribs 57, which separate or define four pie-shaped sections 60. Each cover half 41, 43 is a unitary part, preferably rotationally molded plastic, although injection molding might be used.

Figure 5:
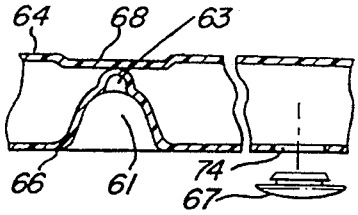
FIG. 5 is a sectional view taken at 5—5 of FIG. 4.

As shown in FIG. 5, each rib 57 is formed by molding the bottom lower surface 66 of the particular cover half 41, 43 to conform to a bell-shaped cross-section, thereby forming a bell-shaped channel or impression 61. At regular intervals, the bell-shaped channel 61 is further provided with domes 63, which extend to meet a recess 68 in the upper surface 64 of a respective cover half 41, 43. Five such domes 63, equally spaced from one another, may be provided in each rib 57. This overall structure provides strength and rigidity to the respective cover halves 41, 43.

Additional intermediate channel areas 62 are also preferably provided to add additional strength to the structure. These channel areas may be substantially identical in cross-section to that of the ribs 57 shown in FIG. 5. Two domes 63 are preferably provided in the intermediate channels 62.

As further illustrated in FIG. 5, openings 74 are provided in the lower surface 66 of each cover half 41, 43. These openings 74 are filled with foam beads such as polystyrene beads, and then plugs 67 are inserted. The beads provide insulation to the cover 13. Such beads could also provide additional structural support if they were molded into a core at the end of the rotational mold cycle.

In the foregoing manner, the cover 13 is provided with an inner skin 66 and outer skin 64 spaced apart from one another, for example, by a mean spacing of 70–80 millimeters, except at a number of selected areas where the two surfaces are brought adjacent to one another by the dome structures 63, thereby facilitating a rotational molding process. A sealed interior providing desirable insulation characteristics is additionally achieved.

Figure 6:
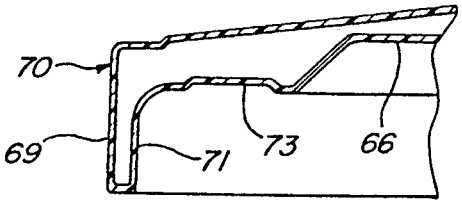
FIG. 6 is a sectional view taken at 6—6 of FIG. 4.

As shown in FIG. 6, the top surface of each cover section 41, 43 angles gently downward to an outer rim 70, which includes an outer vertical wall 69 and an inner vertical wall 71. The inner vertical wall 71 curves through a 90-degree radius to a slightly recessed channel 73 molded to meet and rest on the rim 20 of the spa 11 in order to provide an adequate and effective seal therewith. If desired, this recessed area 73 may be provided with a strip of insulating material to provide a seal between the rim 20 and the cover 13. The rim 70 thus provides a depending skirt which surrounds the outer circumference of the spa 11 and retains the cover 13 in place on the spa 11.

The cover halves 41, 43 feature an integrally molded interlocking hinge mechanism provided by an elongated, tapered female hinge projection 51, an elongated, tapered male hinge projection 50, a central finger extension 47, and first and second side finger extensions 45. Molded indentations 53, 55 (FIG. 4) of rectangular cross-section may be provided to strengthen the area behind the side finger extensions 45.

Figure 7:
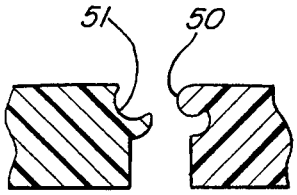
FIG. 7 is a sectional view taken at 7—7 of FIG. 4.
Figures 8, 9, 10:
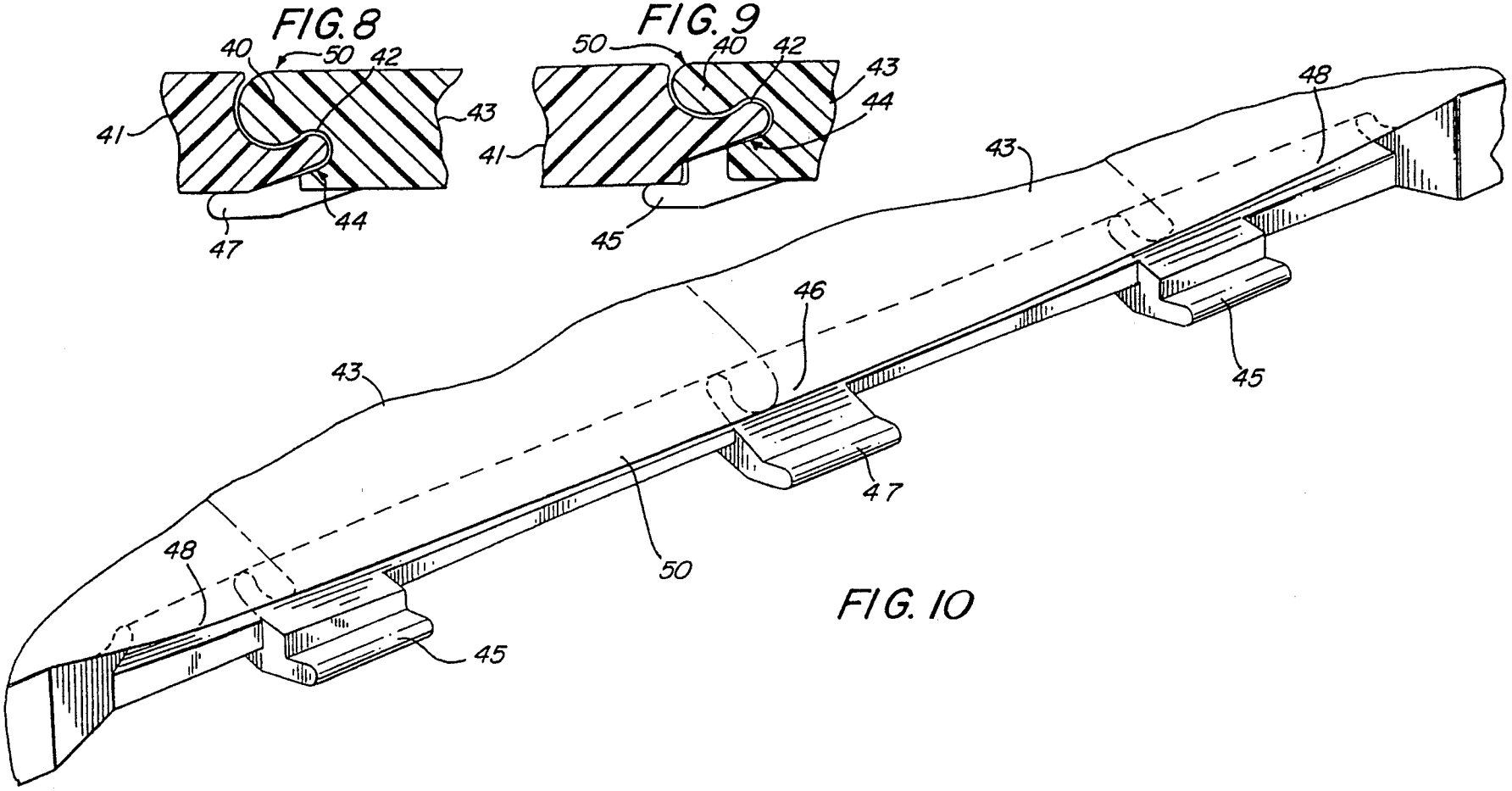
FIG. 8 is a detail illustrating a hinge structure according to the preferred embodiment.
FIG. 9 is a detail illustrating a hinge structure according to the preferred embodiment.
FIG. 10 is a partial, cutaway perspective view of a first cover half according to the preferred embodiment.
Figure 11:
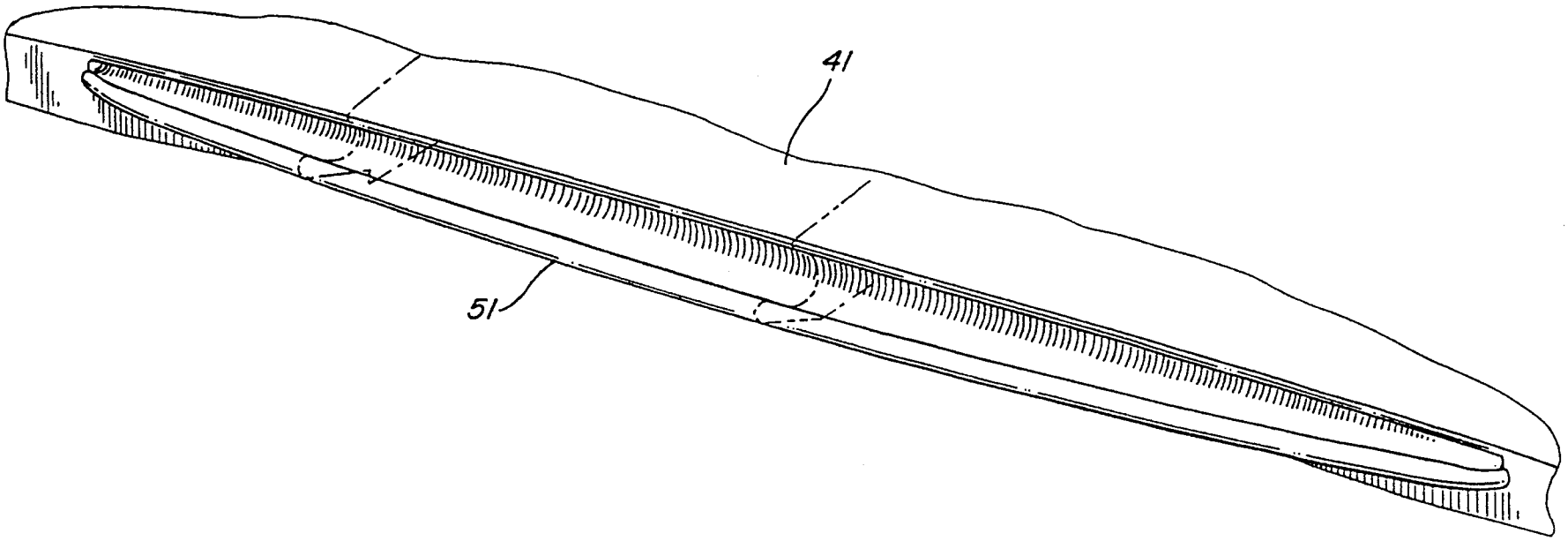
FIG. 11 is a partial, cutaway perspective view of a second cover half according to the preferred embodiment.

FIG. 7 generally illustrates the cross-sectional mating structure of the elongated, tapered projections 51, 50 at the center of the two halves 41, 43, while omitting the finger detail. FIGS. 8 and 9 illustrate in detail the hinge cross-section at the location of the central finger extension 47 and the side finger extensions 45, respectively. As shown, the male projection 50 generally includes a bulbous portion 40 undercut to form a recessed receptacle portion 42, which curves into a descending angled floor portion 44. As illustrated in FIGS. 8–11, this cross-section continuously and symmetrically narrows from the center 46 of hinge projection 50 toward each end 48 thereof, resulting in a profile which generally recedes away from a relatively prominent bulbous crown 46 at the center 46 toward the ends 48.

The female projection 51 is correspondingly contoured to conform to the varying cross-section of the receptacle 42 and the descending floor portion 44 presented by the male projection 51. The resulting interlocking structure cannot be pulled apart when both cover halves 41, 43 are horizontally disposed, but can be pulled apart when one half is elevated to an acute angle with the horizontal, the angle being determined by the geometry of the interlocking structure, particularly the upsweep of receptacle 42 and the clamping action between bulbous portion 40 and the finger extensions 45, 47.

Thus, the two cover halves 41, 43, when lying on a flat plane, e.g., when their inner surfaces 73 are supported by the spa rim 20, are restrained from being pulled apart in a horizontal direction by the interaction of the hinge projections 50, 51 and the fingers 45, 47. Engagement and release of these mated, hinged parts is achieved by raising one of the cover halves 41, 43 to approximately 40 degrees above horizontal. At that point, the hinged halves 41, 43 release and allow separation for easier removal, handling, and storage.

The fingers 45, 47 exhibit resilience and are further preferably disposed to provide an interference fit or bias; that is, the fingers 45, 47 are depressed slightly downward against their biased position as the cover halves 41, 43 interlock, and therefore tend to hold the cover halves 41, 43 in interlocking relationship to create a tight fit. This action is particularly desirable in the face of molding tolerances. The fingers 45, 47 also prevent the engaged cover halves 41, 43 from tending to bow in or out, and thus serve to preserve the horizontal interlocking relationship of the cover halves 41, 43.

The natural locking tendency of the two cover shapes 41, 43 prevents horizontal separation and helps maintain a weathertight seal for the spa. The natural locking tendency of the two shapes 41, 43 further discourages unwanted or unauthorized entry of persons into the spa water, when used in conjunction with external lock-down mechanisms (not shown), which secure the cover halves 41, 43 to the spa proper. Thermal efficiency of the complete package is promoted by reducing loss of heat from the spa water that might occur with a non-joined assembly of cover halves. Such efficiency may be further promoted in some configurations by placement of spongy insulation and sealing material along the portions of the surfaces of the abutting edges 26, 28 which lie adjacent the elongated hinge projections 50, 51. The molded, two-piece cover 13 is also relatively light-weight, lasts twice as long as conventional foam-based lids, can be fabricated to meet ASTM safety standards, and provides other advantages noted above.

It may be noted that the structural advantages of the cover 13 of the preferred embodiment can be adapted to various other cover shapes, for example square or rectangular. In such case, support ribs may run in directions other than radially and the same or similar hinge mechanism may be used.

Those skilled in the art will appreciate that various adaptations and modifications of the just-described preferred embodiment can be configured without departing from the scope and spirit of the invention. Therefore, it is to be understood that, within the scope of the appended claims, the invention may be practiced other than as specifically described herein.

What is claimed is:

1. Spa cover apparatus comprising:

a first rigid molded cover section having a first edge;

a second rigid molded cover section having a second edge; and hinge means for pivotally interlocking said first and second sections along the respective first and second edges and for preventing horizontal disengagement of said first and second sections while permitting disengagement of said first and second sections when one of the sections is raised to an acute angle with the horizontal.

2. The cover of claim 1 wherein said first and second sections are each semicircular in shape.

3. The spa cover of claim 2 wherein each said section includes a plurality of pie-shaped sections and a plurality of radial ribs separating and defining said pie-shaped sections.

4. The spa cover of claim 1 wherein said male and female sections each include an upper surface and a lower surface and a plurality of ribs defined by a bell-shaped contour in said lower surface.

5. The spa cover of claim 4 wherein said bell-shaped contours each include a plurality of dome-shaped upward contours therein.

6. The spa cover of claim 5 wherein said first and second sections provide a continuous outer rim having a downwardly-projecting vertical inner wall leading to indentation means for resting on the top edge of the spa.

7. The spa cover of claim 1 wherein said first edge includes a male hinge projection, a central finger, and first and second side fingers, and wherein said second edge includes female hinge means for interlocking with said male hinge projection and said first and second side fingers.

8. The spa cover of claim 7 wherein said central finger and first and second side fingers press-fittingly engage said second edge.

9. The spa cover of claim 1 wherein said hinge means comprises:

a male projection having, in cross-section, a bulbous portion undercut to form a recessed receptacle curving into a descending angled floor portion; and a female projection contoured to conform to the shape of said bulbous portion and to extend into and conform to the contour of said recessed receptacle and angled floor portion.

10. The spa cover of claim 1 wherein said hinge means further exerts a biasing force tending to hold the first and second sections engaged.

11. Pool cover apparatus comprising first and second cover sections adapted to at least abut against one another along corresponding edges to form a cover having a periphery adapted to seat on a rim of a pool, each section being formed of molded plastic and having an inner skin substantially spaced apart from an outer skin with the exception of a plurality of intermediate zones where the inner skin is formed with impressions which terminate in contact with the outer skin, and wherein the impressions comprise elongated ribs, the inner and outer skins contacting one another at intervals along each rib.

12. The pool cover of claim 11 wherein the abutting edges incorporate opposingly disposed projection means by which one cover section can be approached to abut the other cover section at an angle extending upward and away therefrom and, with lowering, engage the projection means with one another.

13. The cover of claim 12, further including a skirt which depends over and about the spa rim to locate the cover thereon.

14. A pool cover comprising:

first and second cover halves, each having a lower surface and an upper surface;

rib means formed in the lower surfaces of the respective cover halves for strengthening the respective halves; and hinge means for interconnecting and retaining the respective cover halves in horizontal relation with one another while permitting engagement and disengagement of the cover halves when one is raised with respect to the other by an acute angle to the horizontal.

15. The cover of claim 14 wherein said lower and upper surfaces of each cover half are formed as part of a unitary molded cover half having a hollow interior.

16. The cover of claim 15 further comprising insulation means filling the interior of each cover half.

17. The cover of claim 14 wherein each cover half is semicircular.

18. The cover of claim 14 wherein each cover half includes a depending skirt means for locating said cover on a pool.

19. Cover apparatus comprising:

a first rigid molded cover section having a first edge;

a second rigid molded cover section having a second edge;

hinge means for pivotally interlocking said first and second sections along the respective first and second edges; and said first and second sections each including an upper surface and a lower surface and a plurality of ribs defined by a bell-shaped contour in said lower surface, each bell-shaped contour including a plurality of dome-shaped upward contours therein.

20. The cover apparatus of claim 19 wherein said first and second sections are each semicircular in shape.

21. The cover apparatus of claim 20 wherein the plurality of ribs in each said section are radial and define a plurality of pie-shaped sections.

22. The cover apparatus of claim 19 wherein said first edge includes a male hinge projection, a central finger, and first and second side fingers, and wherein said second edge includes female hinge means for interlocking with said male hinge projection and said first and second side fingers.

23. The cover apparatus of claim 22 wherein said central finger and first and second side fingers press-fittingly engage said second edge.

24. The cover apparatus of claim 19 wherein said hinge means prevents horizontal disengagement of said first and second sections while permitting such disengagement when one of the sections is raised to an acute angle with the horizontal.

25. The cover apparatus of claim 24 wherein said hinge means further exerts a biasing force tending to hold the first and second sections engaged.

26. In a cover apparatus, the structure comprising:

a first rigid, single-piece molded section having an upper surface, a lower surface, and a first edge, said upper surface, lower surface, and first edge defining an enclosed hollow interior space;

a second rigid molded section having an upper surface, a lower surface, and a second edge, the upper surface, lower surface, and second edge defining a second enclosed interior space; and a plurality of support structures in each of the first and second rigid molded sections, said support structures each including an upward impression of the respective lower surface into the respective interior space of each of said first and second sections, each said impression comprising a linear groove of uniform cross-section, each said linear groove projects upwardly to contact said upper surface at a plurality of locations.

27. The cover of claim 26 wherein said upper surface of each of said first and second sections is angled with respect to the respective lower surface.

28. The cover of claim 27 wherein said upper surface of each said first and second sections curves away from the respective lower surface.

29. The cover of claim 27 wherein said cross-section has a bell-shaped contour.

30. The cover of claim 29 wherein said bell-shaped contours each include a dome-shaped upward contour therein.

31. The cover of claim 26 further including hinge means for interlocking said first and second sections, said hinge means comprising a male hinge projection, a central finger, and first and second side fingers, and a female hinge means for interlocking with said male hinge projection and said first and second side fingers.

32. The cover of claim 26 further including hinge means for preventing horizontal disengagement of said first and second sections while permitting such disengagement when one of the sections is raised to an acute angle with the horizontal.

33. In a pool cover, the structure comprising first and second sections adapted to at least abut against one another along corresponding edges to form a cover having a periphery adapted to seat on a rim of a pool, each section being formed of molded plastic and having an inner skin substantially spaced apart from an outer skin with the exception of a plurality of intermediate zones, the inner skin having a plurality of support structures formed therein, the support structures each including an upward impression in said inner skin, said impression comprising a linear groove of uniform cross-section, the inner and outer skins contact one another at intervals along each groove.

34. In a cover apparatus, having at least first and second cover halves, the improvement comprising:

hinge means for providing an interlocking engagement of said cover halves, for preventing disengagement of said cover halves when said halves are each horizontally disposed, and for permitting disengagement of the cover halves when one is raised to an acute angle with the horizontal.

35. The cover apparatus of claim 34 wherein said hinge means comprises:

a male projection having, in cross-section, a bulbous portion undercut to form a recessed receptacle curving into a descending angled floor portion; and a female projection contoured to conform to the shape of said bulbous portion and to extend into and conform to the contour of said recessed receptacle and angled floor portion.

36. The cover apparatus of claim 35 wherein one of said first and second sections has an edge and wherein said male projection has a center and first and second ends and extends along said edge and narrows from its center to each end thereof.

* * * * *

UNITED STATES PATENT AND TRADEMARK OFFICE

CERTIFICATE OF CORRECTION

PATENT NO. : 5,398,350
DATED : March 21, 1995
INVENTOR(S) : Jeffrey K. Watkins & Walter R. Cumiskey It is certified that error appears in the above-identified patent and that said Letters Patent is hereby corrected as shown below:

On the title page, item [57], Abstract, line 1, after "A portable spa ", delete " including a ".

On the title page, item [57], Abstract, line 3, after " rim of " , delete " the " and substitute - - a - - therefor.

Column 7, line 41, delete " projects " and subsitiute therefor - - projecting- - .

Column 8, line 24, after " skin ," insert - - each - - .

Column 8, line 26, delete " contact " and substitute therefor - - contacting- - .

Signed and Sealed this

Thirty-first Day of October 1995

*Attest:*

Bruce Lehman

BRUCE LEHMAN

*Attesting Officer*

*Commissioner of Patents and Trademarks*